US007902139B2

(12) United States Patent
Batchelor et al.

(10) Patent No.: US 7,902,139 B2
(45) **Date of Patent: *Mar. 8, 2011**

(54) SHADING COMPOSITION

(75) Inventors: Stephen Norman Batchelor, Wirral (GB); Jayne Michelle Bird, Wirral (GB)

(73) Assignee: Conopco Inc., Englewood Cliffs, NJ (US)

( * ) Notice: Subject to any disclaimer, the term of this patent is extended or adjusted under 35 U.S.C. 154(b) by 10 days.

This patent is subject to a terminal disclaimer.

(21) Appl. No.: 12/085,120

(22) PCT Filed: Jul. 13, 2007

(86) PCT No.: PCT/EP2007/057264

§ 371 (c)(1),
(2), (4) Date: Mar. 26, 2009

(87) PCT Pub. No.: WO2008/017570

PCT Pub. Date: Feb. 14, 2008

(65) Prior Publication Data

US 2009/0217467 A1 Sep. 3, 2009

(30) Foreign Application Priority Data

Aug. 10, 2006 (EP) ..... 06118742

(51) Int. Cl.
*C11D 3/40* (2006.01)

(52) U.S. Cl. ..... 510/276; 8/137; 8/137.5

(58) Field of Classification Search ..... 8/137, 137.5; 252/276; 510/276

See application file for complete search history.

(56) References Cited

U.S. PATENT DOCUMENTS

| | | | | |
|---|---|---|---|---|
| 3,544,342 | A | 12/1970 | Numrich | 106/19 |
| 3,644,270 | A | 2/1972 | Valiaveedan | 260/40 R |
| 3,762,859 | A | 10/1973 | Wixon et al. | 8/18 |
| 3,879,464 | A | 4/1975 | Kalopissis et al. | 260/584 |
| 3,923,453 | A * | 12/1975 | Lazar et al. | 8/611 |
| 5,445,755 | A * | 8/1995 | Convents et al. | 510/305 |
| 2010/0115707 | A1 * | 5/2010 | Batchelor et al. | 8/137 |

FOREIGN PATENT DOCUMENTS

| | | | |
|---|---|---|---|
| EP | 1 645 296 | | 4/2006 |
| WO | 2006/021285 | | 3/2006 |
| WO | 2006/032327 | | 3/2006 |
| WO | WO 2006/053598 | * | 5/2006 |

OTHER PUBLICATIONS

PCT International Search Report in a PCT application PCT/EP2007/057264.

EP Search Report in EP application EP 06 11 8742.

* cited by examiner

*Primary Examiner* — Lorna M Douyon
*Assistant Examiner* — Amina Khan
(74) *Attorney, Agent, or Firm* — Rimma Mitelman

(57) ABSTRACT

A laundry treatment composition comprising: (i) from 2 to 70 wt % of a surfactant, and from 0.0001 to 0.1 wt % of an azine dye, wherein the dye is of the following core structure (I), wherein $R_a$, $R_b$, $R_c$, and $R_d$ are selected from: H, an branched or linear C1 to C7-alkyl chain, benzyl a phenyl, and a naphthyl; the dye is substituted with at least one $SO_3^-$ or —$COO^-$ group; the B ring does not carry a negatively charged group or salt thereof; and the A ring may further substituted to form a naphthyl; the dye is optionally substituted by groups selected from: amine, methyl, ethyl, hydroxyl, methoxy, ethoxy, phenoxy, Cl, Br, I, F, and $NO_2$.

(I)

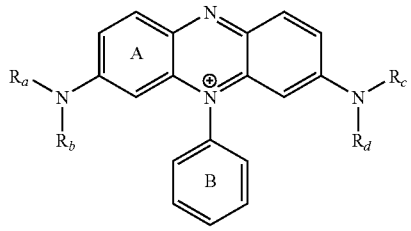

15 Claims, No Drawings

SHADING COMPOSITION

FIELD OF INVENTION

The present invention relates to the delivery of dyes to fabrics.

BACKGROUND OF THE INVENTION

Many garments yellow over multiple wash wear cycles, reducing the aesthetic value of the garment. In order to maintain the white appearance shading dyes may be used. For main wash applications these are preferably blue or violet dyes of the acid, direct or hydrolysed reactive dye classes. A number of problems arise during use that are dependent on the class of dye.

Direct dyes build up over multiple washes, and this can lead to a strong blue or violet colour on the garment. To make this overshading acceptable lower level of dye must be used reducing the benefit.

Acid dyes have the advantage that they do not build up over multiple washes. However no single acid dye has been found that shows high deposition to cotton and gives a true blue or violet shade to the cloth. Many are too green in colour for optimum shading effects. Additionally many acid dyes that deposit to cotton also deposit on nylon and this leads to overshading of nylon after multiple washes.

SUMMARY OF INVENTION

We have found that some acid azine dyes whilst depositing well on cotton substrates deposit poorly on nylon and are capable of providing a true blue shade to the cotton substrate.

In one aspect the present invention provides a laundry treatment composition comprising:

(i) from 2 to 70 wt % of a surfactant, and from 0.0001 to 0.1 wt % of an azine dye, wherein the dye is of the following core structure:

(I)

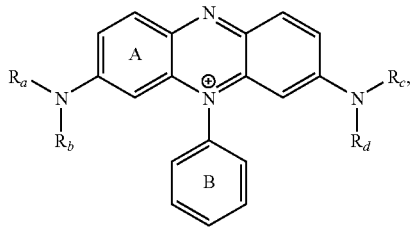

wherein $R_a$, $R_b$, $R_c$ and $R_d$ are selected from: H, a branched or linear C1 to C7-alkyl chain, benzyl a phenyl, and a naphthyl; the dye is substituted with at least one $SO_3^-$ or —$COO^-$ group; the B ring does not carry a negatively charged group or salt thereof;

and the A ring may further substituted to form a naphthyl; the dye is optionally substituted by groups selected from: amine, methyl, ethyl, hydroxyl, methoxy, ethoxy, phenoxy, Cl, Br, I, F, and $NO_2$.

In another aspect the present invention provides a domestic method of treating a textile, the method comprising the steps of:

(i) treating a textile with an aqueous solution of an acid azine dye as defined in any one of claims 1 to 7, the aqueous solution comprising from 1 ppb to 1 ppm of the dye, and from 0 ppb to 1 ppm of another dye selected from: hydrophobic dyes and direct dyes; and, from 0.0 g/L to 3 g/L of a surfactant; and, (ii) rinsing and drying the textile.

Preferably the method is conducted where the aqueous solution is 10 to 30° C. This aids deposition of the azine dye.

Preferably the aqueous solution contains from 0.3 to 2.5 g/L surfactant.

The pH of the aqueous solution, provided by a unit dose of the laundry treatment composition is in the range from 2 to 12. Preferably the pH of the aqueous solution is in the range from 7 to 11.

Preferably the azine dye is present from 10 ppb to 200 ppb of the dye.

Preferably the hydrophobic dye is present in the range 10 ppb to 200 ppb.

Preferably the direct dye is present in the range from 2 ppb to 40 ppb.

Preferably the aqueous solution has an ionic strength of greater than 0.01, more preferably greater than 0.05.

The invention may also be used to enhance black and blue garments on washing.

The present invention also extends to a commercial package comprising the laundry treatment composition together with instructions for its use.

Photobleaches may be used in the present invention but preferably a photobleach is not present.

DETAILED DESCRIPTION OF THE INVENTION

Dyes

It is within the scope of the invention to have a mixture of a direct dye, hydrophobic dyes and azine dye. This does not preclude the presence of other classes of dye.

The dyes are preferably added to granular products via the surfactant slurry or via post-dosed granules.

If more than one dye is used then for a powder formulation it is preferred that the shading dyes are co-granulated.

All dye levels refer to pure dye.

Azine Dye

With respect to the azine dye of core structure (I) it is preferred that the A ring is further substituted to form a naphthyl. The dye is preferably substituted by two $SO_3^-$ group and no other charged substituents. One skilled in the art will appreciate that the metal cation that is exemplified as sodium may be easily varied and such is within the scope of the invention, for example, such as alkali earth metals and alkaline earth metals and these are preferred, in particular potassium and calcium.

One skilled in the art will appreciate that apart from the requirement that the azine dye is substituted with at least one $SO_3^-$ or —$COO^-$ group and that the B ring does not carry a negatively charged group or salt thereof the latitude to vary substituents is large without effecting the efficacy of the dye to deposit on cotton as required. The groups $R_a$, $R_b$, $R_c$ and $R_d$ as specified above may carry other substituents.

With respect to the B ring not carrying a negatively charged group B this in particular a SO3− or COO−.

Preferably the dye has the following structure:

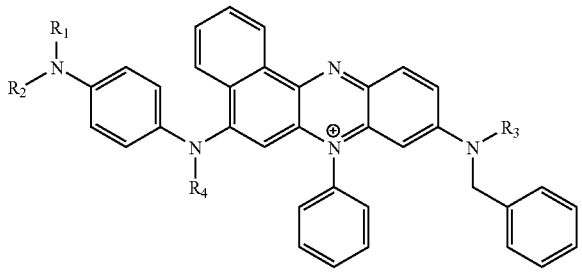

wherein $R_1$, $R_2$, $R_3$ and $R_4$ is selected from the group consisting of: H, Me, Et, n-Pr and i-Pr; and the dye is optionally substituted by a methoxy group.

A preferred dye is of the following structure:

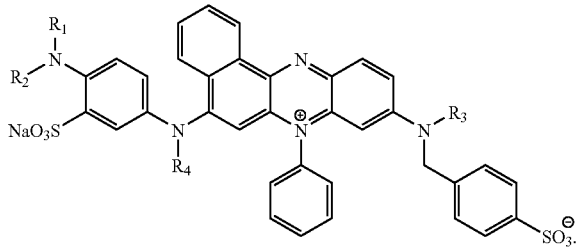

Preferred azine dyes are: acid blue 98, acid violet 50, and acid blue 59, more preferably acid violet 50 and acid blue 98.

Most preferably the azine dye is acid blue 98.

The azine dye is present in the formulation at levels of 0.00001 to 0.1%, preferably 0.0001 to 0.01%, most preferably 0.0005 to 0.005%.

In a preferred embodiment of the invention, the main wash formulation contains further shading dyes selected from hydrophobic dyes, most preferably solvent violet 13 or disperse violet 27. These dyes give benefits to synthetic fibres such as elastane and polyester. The hydrophobic dyes are preferably blue or violet.

The hydrophobic dyes are preferably present at levels of 0.0001 to 0.1% preferably 0.0005 to 0.005 wt %.

In a preferred embodiment of the invention, the main wash formulation contains further shading dyes selected from direct violet and direct blue dyes.

In this embodiment the acid dye provides a shading in the first few washes that is visual and pleasing. The effect of the direct dye only becomes visible after multiple washes and serves to counteract the long term yellowing.

In this way, both rejuvenation and whiteness maintenance may be provided to the consumer.

Azine dyes have advantage over triphenylmethane dyes in that they are more stable to high pH.

Hydrophobic Dye

Hydrophobic dyes are defined as organic compounds with a maximum extinction coefficient greater than 1000 L/mol/cm in the wavelength range of 400 to 750 nm and that are uncharged in aqueous solution at a pH in the range from 7 to 11. The hydrophobic dyes are devoid of polar solubilizing groups. In particular the hydrophobic dye does not contain any sulphonic acid, carboxylic acid, or quaternary ammonium groups. The dye chromophore is preferably selected from the group comprising: azo; anthraquinone; phthalocyanine; benzodifuranes; quinophthalones; azothiophenes; azobenzothioazoles and, triphenylmethane chromophores. Most preferred are azo and anthraquinone dye chromophores.

Many examples of hydrophobic dyes are found in the classes of solvent and disperse dyes.

Shading of white garments may be done with any colour depending on consumer preference. Blue and Violet are particularly preferred shades and consequently preferred dyes or mixtures of dyes are ones that give a blue or violet shade on white.

A wide range of suitable solvent and disperse dyes are available. However detailed toxicological studies have shown that a number of such dyes are possible carcinogens, for example disperse blue 1. Such dyes are not preferred. More suitable dyes may be selected from those solvent and disperse dyes used in cosmetics. For example as listed by the European Union in directive 76/768/EEC Annex IV part 1. For example disperse violet 27 and solvent violet 13.

Preferred azo hydrophobic dykes for use in the present invention are: Disperse blue 10, 11, 12, 21, 30, 33, 36, 38, 42, 43, 44, 47, 79, 79:1, 79:2, 79:3, 82, 85, 88, 90, 94, 96, 100, 101, 102, 106, 106:1, 121, 122, 124, 125, 128, 130, 133, 137, 138, 139, 142, 146, 148, 149, 165, 165:1, 165:2, 165:3, 171, 173, 174, 175, 177, 183, 187, 189, 193, 194, 200, 201, 202, 205, 206, 207, 209, 210, 211, 212, 219, 220, 222, 224, 225, 248, 252, 253, 254, 255, 256, 257, 258, 259, 260, 264, 265, 266, 267, 268, 269, 270, 278, 279, 281, 283, 284, 285, 286, 287, 290, 291, 294, 295, 301, 303, 304, 305, 313, 315, 316, 317, 319, 321, 322, 324, 328, 330, 333, 335, 336, 337, 338, 339, 340, 341, 342, 343, 344, 345, 346, 351, 352, 353, 355, 356, 358, 360, 366, 367, 368, 369, 371, 373, 374, 375, 376 and 378, Disperse Violet 2, 3, 5, 6, 7, 9, 10, 12, 13, 16, 24, 25, 33, 39, 42, 43, 45, 48, 49, 50, 53, 54, 55, 58, 60, 63, 66, 69, 75, 76, 77, 82, 86, 88, 91, 92, 93, 93:1, 94, 95, 96, 97, 98, 99, 100, 102, 103, 104, 106 or 107, Dianix violet cc, and dyes with CAS-No's 42783-06-2, 210758-04-6, 104366-25-8, 122063-39-2, 167940-11-6, 52239-04-0, 105076-77-5, 84425-43-4, and 87606-56-2.

Preferred anthraquinone hydrophobic dykes for use in the present invention are: Solvent Violet 11, 13, 14, 15, 15, 26, 28, 29, 30, 31, 32, 33, 34, 26, 37, 38, 40, 41, 42, 45, 48, 59; Solvent Blue 11, 12, 13, 14, 15, 17, 18, 19, 20, 21, 22, 35, 36, 40, 41, 45, 59, 59:1, 63, 65, 68, 69, 78, 90; Disperse Violet 1, 4, 8, 11, 11:1, 14, 15, 17, 22, 26, 27, 28, 29, 34, 35, 36, 38, 41, 44, 46, 47, 51, 56, 57, 59, 60, 61, 62, 64, 65, 67, 68, 70, 71, 72, 78, 79, 81, 83, 84, 85, 87, 89, 105; Disperse Blue 2, 3, 3:2, 8, 9, 13, 13:1, 14, 16, 17, 18, 19, 22, 23, 24, 26, 27. 28, 31, 32, 34, 35, 40, 45, 52, 53, 54, 55, 56, 60, 61, 62, 64, 65, 68, 70, 72, 73, 76, 77, 80, 81, 83, 84, 86, 87, 89, 91, 93, 95, 97, 98, 103, 104, 105, 107, 108, 109, 11, 112, 113, 114, 115, 116, 117, 118, 119, 123, 126, 127, 131, 132, 134, 136, 140, 141, 144, 145, 147, 150, 151, 152, 153, 154, 155, 156, 158, 159, 160, 161, 162, 163, 164, 166, 167, 168, 169, 170, 176, 179, 180, 180:1, 181, 182, 184, 185, 190, 191, 192, 196, 197, 198, 199, 203, 204, 213, 214, 215, 216, 217, 218, 223, 226, 227, 228, 229, 230, 231, 232, 234, 235, 236, 237, 238, 239, 240, 241, 242, 243, 244, 245, 246, 247, 249, 252, 261, 262, 263, 271, 272, 273, 274, 275, 276, 277, 289, 282, 288, 289, 292, 293, 296, 297, 298, 299, 300, 302, 306, 307, 308, 309, 310, 311, 312, 314, 318, 320, 323, 325, 326, 327, 331, 332, 334, 347, 350, 359, 361, 363, 372, 377 and 379.

Other preferred (non-azo) (non-anthraquinone) hydrophobic dykes for use in the present invention are: Disperse Blue 250, 354, 364, 366, Solvent Violet 8, solvent blue 43, solvent blue 57, Lumogen F Blau 650, and Lumogen F Violet 570.

Solvent violet 13 is most preferred.

Direct Dye

The direct violet or direct blue dye is preferably present at levels of 0.00001 to 0.001% preferably 0.0001 to 0.0005%.

The following are preferred direct dyes that may be used with the present invention.

Preferred direct dyes are selected from the group comprising tris-azo direct blue dyes of the formula:

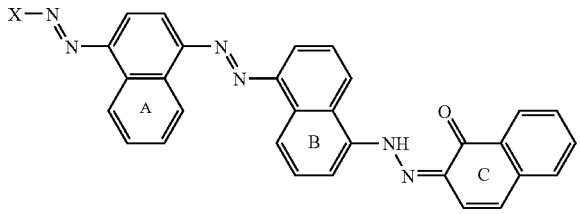

where at least two of the A, B and C napthyl rings are substituted by a sulphonate group, the C ring may be substituted at the 5 position by an $NH_2$ or NHPh group, X is a phenyl or napthyl ring substituted with upto 2 sulphonate groups and may be substituted at 2 position with a OH group and may also be substituted with an $NH_2$ or NHPh group, Other preferred direct dyes are selected from the group comprising bis-azo direct violet dyes of the formula:

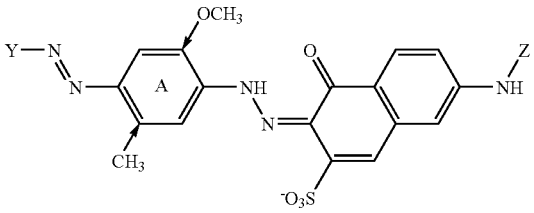

where Z is H or phenyl, the A ring is preferably substituted by a methyl and methoxy group at the positions indicated by arrows, the A ring may also be a naphthyl ring, the Y group is a phenyl or naphthyl ring, which is substituted by sulphate group and may be mono or disubstituted by methyl groups.

Non-limiting examples of these dyes are direct violet 5, 7, 9, 11, 31, and 51. Further non-limiting examples of these dyes are also direct blue 34, 70, 71, 72, 75, 78, 82, and 120. Preferably the dye is direct violet 9.

Surfactant

The composition comprises between 2 to 70 wt % of a surfactant, most preferably 10 to 30 wt %. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981. Preferably the surfactants used are saturated.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$ to $C_{22}$ alkyl phenol-ethylene oxide condensates, generally 5 to 25 EO, i.e. 5 to 25 units of ethylene oxide per molecule, and the condensation products of aliphatic $C_8$ to $C_{18}$, primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$ to $C_{15}$ alkyl benzene sulphonates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$ to $C_{18}$ primary alcohol sulphate together with a $C_{12}$ to $C_{15}$ primary alcohol 3 to 7 EO ethoxylate.

The nonionic detergent is preferably present in amounts greater than 10%, e.g. 25 to 90 wt % of the surfactant system. Anionic surfactants can be present for example in amounts in the range from about 5% to about 40 wt % of the surfactant system.

In another aspect which is also preferred the surfactant may be a cationic such that the formulation is a fabric conditioner.

Cationic Compound

When the present invention is used as a fabric conditioner it needs to contain a cationic compound.

Most preferred are quaternary ammonium compounds.

It is advantageous if the quaternary ammonium compound is a quaternary ammonium compound having at least one $C_{12}$ to $C_{22}$ alkyl chain.

It is preferred if the quaternary ammonium compound has the following formula:

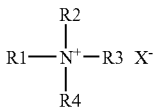

in which $R^1$ is a $C_{12}$ to $C_{22}$ alkyl or alkenyl chain; $R^2$, $R^3$ and $R^4$ are independently selected from $C_1$ to $C_4$ alkyl chains and $X^-$ is a compatible anion. A preferred compound of this type is the quaternary ammonium compound cetyl trimethyl quaternary ammonium bromide.

A second class of materials for use with the present invention are the quaternary ammonium of the above structure in which $R^1$ and $R^2$ are independently selected from $C_{12}$ to $C_{22}$ alkyl or alkenyl chain; $R^3$ and $R^4$ are independently selected from $C_1$ to $C_4$ alkyl chains and $X^-$ is a compatible anion.

A detergent composition according to claim 1 in which the ratio of (ii) cationic material to (iv) anionic surfactant is at least 2:1.

Other suitable quaternary ammonium compounds are disclosed in EP 0 239 910 (Proctor and Gamble).

It is preferred if the ratio of cationic to nonionic surfactant is from 1:100 to 50:50, more preferably 1:50 to 20:50.

The cationic compound may be present from 1.5 wt % to 50 wt % of the total weight of the composition. Preferably the cationic compound may be present from 2 wt % to 25 wt %, a more preferred composition range is from 5 wt % to 20 wt %.

The softening material is preferably present in an amount of from 2 to 60% by weight of the total composition, more preferably from 2 to 40%, most preferably from 3 to 30% by weight.

The composition optionally comprises a silicone.

Fluorescent Agent

The composition preferably comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 0.1 wt %. Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2 (4-styryl-3-sulfophenyl)-2H-napthol[1,2-d]trazole, disodium 4,4'-bis{[(4-anilino-6-(N methyl-N-2 hydroxyethyl)amino 1,3,5-triazin-2-yl)] amino}stilbene-2-2' disulfonate, disodium 4,4'-bis{[(4-anilino-6-morpholino-1,3,5-triazin-2-yl)]amino}stilbene-2-2' disulfonate, and disodium 4,4'-bis(2-sulfoslyryl)biphenyl.

Perfume

Preferably the composition comprises a perfume. The perfume is preferably in the range from 0.001 to 3 wt %, most preferably 0.1 to 1 wt %. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

EXPERIMENTAL

The azine dyes used have the following structures:

Acid blue 18

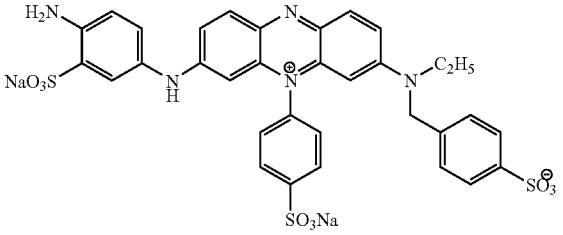

-continued

Acid blue 59

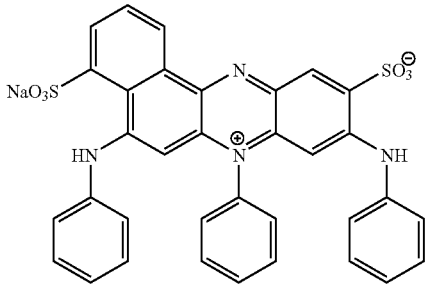

Acid blue 98

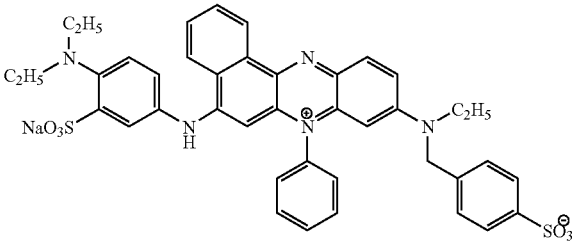

Example 1

Acid dyes were tested for shading benefit by separately washing cotton and nylon cloth at room temperature, in 1.8 g/L of a base washing powder which contained: 18% NaLAS, 73% salts (silicate, sodium tri-poly-phosphate, sulphate, carbonate), 3% minors including perborate, fluorescer and enzymes, remainder impurities and water. A liquor to cloth of with a 100:1 was used, the washes lasted for 30 mins, and were conducted with and without the addition of 200 part per billion of the shading dye. All dyes were used as received. Following the wash, the cloths were rinsed then dried. The colour of the cloth was then assessed using a reflectometer (UV excluded for all measurements) and expressed as the ΔE value relative to cloth washed without dye. The colour of the cloth was expressed in CIELAB colour space as the a* (red-green axis) and b* (blue-yellow axis) values.

The dyes tested and results are given in the table below for cotton.

| Dye | Chromophore | ΔE | a* | b* |
|---|---|---|---|---|
| Control (no dye) | — | — | −0.42 | 1.11 |
| Acid black 1 | Azo | 5.5 | −3.58 | −2.06 |
| Acid Violet 17 | Triphenylmethane | 2.1 | −0.4 | −0.49 |
| Acid blue 25 | Anthraquinone | 3.0 | −2.31 | −0.85 |
| Acid blue 29 | Azo | 4.1 | −2.17 | −1.48 |
| Acid blue 62 | Anthraquinone | 1.9 | −1.67 | −0.17 |
| Acid blue 18 | Azine | 0.7 | −0.46 | 0.47 |
| Acid blue 59 | Azine | 3.5 | −1.56 | −1.62 |
| Acid blue 98 | Azine | 4.8 | 0.02 | −2.56 |

As can be seen from the results all dyes show some deposition to the cotton reflected by the ΔE values. Best deposition of colour (ΔE>3) is given by acid black 1, acid blue 29, acid blue 59 and acid blue 98. Acid blue 59 and acid blue 98 are less green than acid black 1 and acid blue 29 as shown by the a* and b* values. Acid blue 98 gives the best colour changes, with the predominate change in the blue direction (large decrease in b*, little change in a* relative to control).

The results for nylon are shown below

| Dye | Chromophore | ΔE |
|---|---|---|
| Control (no dye) | — | — |
| Acid black 1 | Azo | 0.3 |
| Acid Violet 17 | Triphenylmethane | 0.1 |
| Acid blue 25 | Anthraquinone | 1.2 |
| Acid blue 29 | Azo | 0.1 |
| Acid blue 62 | Anthraquinone | 0.6 |
| Acid blue 18 | Azine | 0.1 |
| Acid blue 59 | Azine | 0.5 |
| Acid blue 98 | Azine | 0.1 |

The azine dyes show low deposition onto nylon.

Example 2

A wash load was created containing 80% white cotton sheeting and 20% of 65:35 polyester-cotton sheeting. This was washed in 2 g/L of the base washing powder described in example 1, rinsed and dried. The liquor to cloth ratio was 16:1. The experiment was repeated but with addition of shading dyes to the base washing powder, Two shading formulation was created, containing:

(a) 0.005 wt % acid blue 98

(b) 0.005 wt % acid blue 98, 0.001 wt % direct violet 9 and 0.004 wt % solvent violet 13. The solvent violet 13 was added via a zeolite/non-ionic granule which contained 0.2% dye.

The wash experiment was repeated with these formulations.

Following drying the reflectance spectrum of the cloth were recorded (UV-excluded to remove the effect of the fluorescer) From the reflectance values the K/S values were calculated via the Kubelka-Munk equation $$K/S=(1-R)^2/2R \text{ where R=\% reflectance/100}$$

K/S is proportional to the dye loading on the cloth.

As the dyes have maximum optical absorption in the range 550-600 nm the K/S values were summed over this range.

The washes were then repeated and further measurement taken. The cotton sheeting results are given below:

| | ΔK/S compared to control | | | |
|---|---|---|---|---|
| | Wash 1 | Wash 2 | Wash 3 | Wash 4 |
| (a) | 0.0166 | 0.0184 | 0.0251 | 0.0259 |
| (b) | 0.0161 | 0.0231 | 0.0331 | 0.0363 |

ΔK/S is the difference between control and shading formulation washed cloth.

The results for (a) show that Acid blue 98 does not build up linearly over multiple washes. After the $3^{rd}$ wash the dye loading becomes constant. In analogous experiment with direct dyes, such as direct violet 51 and direct violet 9, ΔK/S constantly increases with wash number indicating a linear build up of dye. In (b) the effect of a small addition of direct violet 9 to the formulation is seen, with ΔK/S gradually increasing over multiple washes. The acid blue 98 provides a large shading benefit in the first washes and the direct violet 9 counteracts long term yellowing.

For polycotton only small benefits were seen with (a), however with (b) due to the addition of solvent violet 13 good shading benefits were observed. This was indicated by a ΔK/S of 0.0202 after the $4^{th}$ wash.

A 12.5 ppm solution of the acid blue 98 used in these experiments had an optical density (1 cm) at its absorption maximum in the visible region of 0.67.

The solvent violet 13 and direct violet 9 used were of high purity (95%+).

The invention claimed is:

1. A laundry treatment composition comprising:

(i) from 2 to 70 wt % of a surfactant comprising water-soluble alkali metal salts of organic sulphates and sulphonates having alkyl radicals containing from about 8 to about 22 carbon atoms; and ii) from 0.0001 to 0.1 wt % of an azine dye, wherein the dye is of the following core structure:

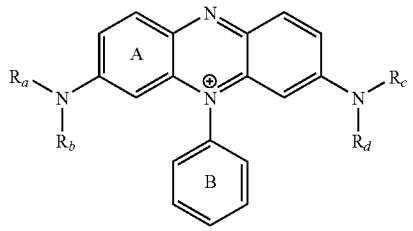

wherein $R_a$, $R_b$, $R_c$ and $R_d$ are selected from: H, an branched or linear C1 to C7-alkyl chain, benzyl a phenyl, and a naphthyl;

the dye is substituted with at least one $SO_3^-$ or —$COO^-$ group;

the B ring does not carry a negatively charged group or salt thereof;

and the A ring may further substituted to form a naphthyl;

the dye is optionally substituted by groups selected from: amine, methyl, ethyl, hydroxyl, methoxy, ethoxy, phenoxy, Cl, Br, I, F, and $NO_2$, wherein the A ring is further substituted to form a naphthyl.

2. A laundry treatment composition according to claim 1, wherein the dye is substituted by two $SO_3$— group and no other charged substituents.

3. A laundry treatment composition according to claim 1, wherein the dye has the following core structure:

(II)

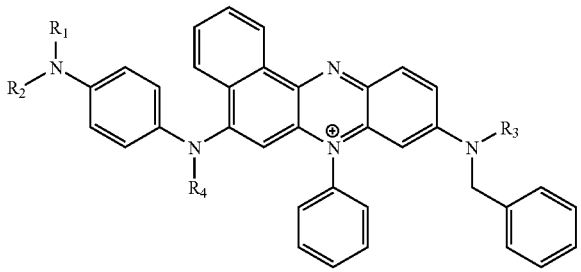

wherein $R_1$, $R_2$, $R_3$ and $R_4$ is selected from the group consisting of: H, Me, Et, n-Pr and i-Pr; and the dye is optionally substituted by a methoxy group.

4. A laundry treatment composition according to claim 3, wherein dye has the following structure:

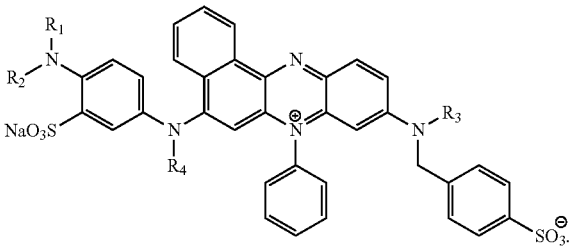

5. A laundry treatment composition according to claim 1, wherein the azine dye is selected from the group: acid blue 98, acid violet 50, and acid blue 59.

6. A laundry treatment composition according to claim 5, wherein the azine dye is acid blue 98.

7. A laundry treatment composition according to claim 1, wherein the composition compromised a further shading dye selected from the group consisting of: direct dye and hydrophobic dye.

8. A laundry treatment composition according to claim 7, wherein the hydrophobic dyes is selected from: solvent violet 13 and disperse violet 27.

9. A laundry treatment composition according to claim 7, wherein the direct dye is selected from: direct violet 9, 51 and 35.

10. A laundry treatment composition according to claim 7, wherein the direct dye is present at a level from 0.00001 to 0.001 wt %.

11. A laundry treatment composition according to claim 8, wherein the hydrophobic dye is present at a level from 0.00001 to 0.01 wt %.

12. A domestic method of treating a textile, the method comprising the steps of:

(i) treating a textile with an aqueous solution of an acid azine dye as defined in claim 1, the aqueous solution comprising from 1 ppb to 1 ppm of the dye, and from 0 ppb to 1 ppm of another dye selected from: hydrophobic dyes and direct dyes; and, from 0.2 g/L to 3 g/L of a surfactant; and, (ii) rinsing and drying the textile.

13. A method according to claim 12, wherein the azine dye is present from 10 ppb to 200 ppb.

14. A method according to claim 12, wherein a hydrophobic dye is present in the range of 10 ppb to 200 ppb.

15. A method according to claim 12, wherein a direct dye is present in the range from 2 ppb to 40 ppb.

* * * * *